US005958158A

United States Patent [19]

Kron et al.

[11] Patent Number: 5,958,158

[45] Date of Patent: Sep. 28, 1999

[54] METHOD OF MANUFACTURING HOT-WORKED ELONGATED PRODUCTS, IN PARTICULAR BAR OR PIPE, FROM HIGH ALLOY OR HYPEREUTECTOIDAL STEEL

[75] Inventors: Heinz Kron, Düsseldorf; Karlheinz Kutzenberger, Monheim; Gunther Manig, Peritz; Gustav Zouhar, Dresden, all of Germany

[73] Assignee: Mannesmann Aktiengesellschaft, Düsseldorf, Germany

[21] Appl. No.: 08/930,139

[22] PCT Filed: Mar. 12, 1996

[86] PCT No.: PCT/DE96/00501

§ 371 Date: Nov. 10, 1997

§ 102(e) Date: Nov. 10, 1997

[87] PCT Pub. No.: WO96/31628

PCT Pub. Date: Oct. 10, 1996

[30] Foreign Application Priority Data

Apr. 3, 1995 [DE] Germany ..... 195 13 314

[51] Int. Cl.[6] ..... C12D 8/06; C12D 8/10

[52] U.S. Cl. ..... 148/598; 148/600; 148/593; 148/594; 72/200; 72/201; 72/226

[58] Field of Search ..... 148/598, 60 D, 148/593, 594; 72/200, 201, 226

[56] References Cited

U.S. PATENT DOCUMENTS 5,252,153 10/1993 Ochi et al. ..... 148/598
5,458,649 10/1995 Tsukamoto et al. ..... 148/598

*Primary Examiner*—Deborah Yee
*Attorney, Agent, or Firm*—Cohen, Pontani, Lieberman & Pavane

[57] ABSTRACT

The invention relates to a process for producing hot-worked elongated products, such as bars or tubes, from high-alloy or hypereutectoid steel in which a feedstock is heated to a deformation temperature and undergoes at least one deformation step. Following the at least one deformation step, the deformed feedstock is either cooled or heated at a specific temperature to achieve a uniform temperature distribution throughout the length and thickness of the deformed feedstock. Next the deformed feedstock is reheated to a temperature below the deformation temperature. The reheated feedstock is continuously rolled in a multi-stand reducing mill to its final size and then cooled by ambient air.

10 Claims, 1 Drawing Sheet v 1000 : 1

Structure after the process according to the invention without annealing

Fig.1
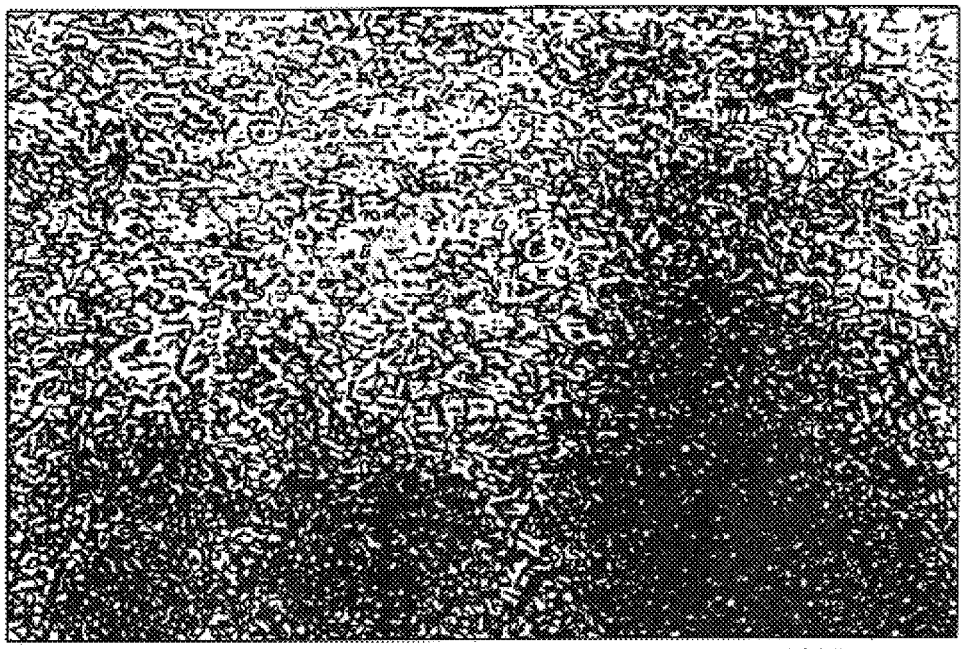
PRIOR ART v 1000:1
Structure after the known process and spheroidal cementite annealing
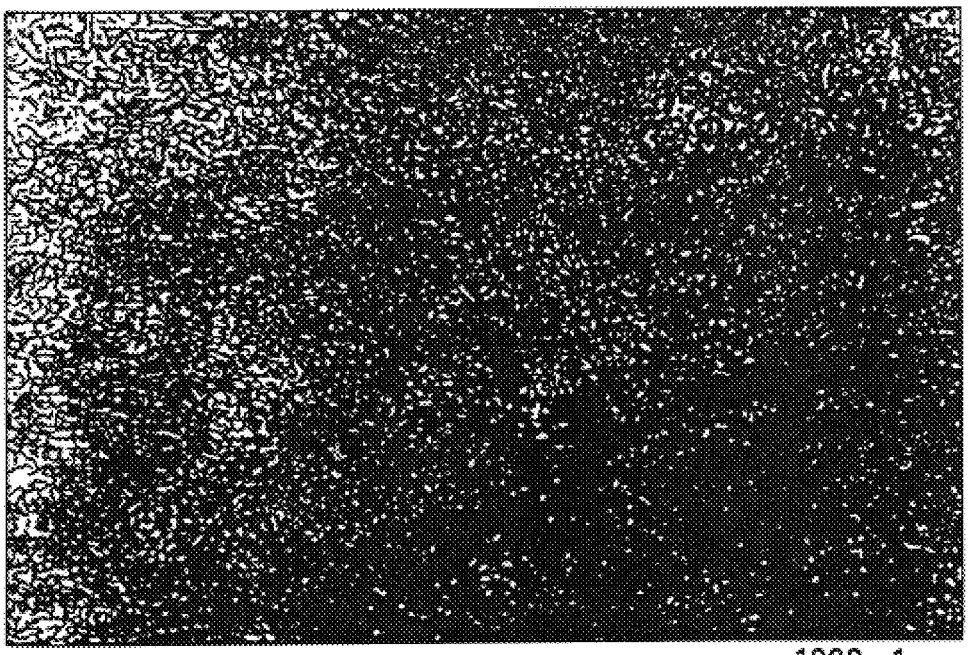
v 1000 : 1
Structure after the process according to the invention without annealing
Fig. 2

METHOD OF MANUFACTURING HOT-WORKED ELONGATED PRODUCTS, IN PARTICULAR BAR OR PIPE, FROM HIGH ALLOY OR HYPEREUTECTOIDAL STEEL

FIELD OF THE INVENTION

The invention relates to a process for manufacturing hot-worked elongated products, particularly bars or pipes, from high-alloy or hypereutectoid steel.

BACKGROUND

High-alloy or hypereutectoid steels, especially anti-friction bearing steels such as 100Cr6, form grain boundary carbides and pearlitic microstructural components when cooled from high temperatures (1100 to 1250° C.). These formations impede mechanical workability and hardenability as well as chipless deformation. A spheroidal cementite microstructure suitable for further processing can be achieved only after long annealing processes (spheroidal cementite annealing) of 16 hours or more. Much thought has been given to the question of how to shorten the duration of this soft annealing or whether the annealing can be replace altogether.

F. Mladen and E. Hornbogen studied the influence of thermomechanical processing on the mechanical properties of 100Cr6 steel (Archiv Eisenhuettenwesen 49 (1978) No. 2, pp. 449 to 453). Austenitizing was carried out above the temperature at which $Fe_3C$ completely dissolves which, given a 0.99 C w/o, is somewhat less than 1100° C. Hot rolling began at 1100° C. with simultaneous cooling to 720° C. Cooling from 720° C. to ambient temperature was accomplished by water quenching. The details of the deformation sequence are not discussed in the article. The thermomechanically treated microstructure displayed such a finely dispersed distribution of carbides that the resolution limits of the optical microscope were reached. The reason for this improved distribution was the increase in dislocation density and the subgrain boundaries created by dislocations, which resulted in new nucleation sites for the carbides.

A process for producing cylindrical rolled bodies from steel 0.7 to 1.2 with a carbon w/o is known from DE PS 2361330. In this process, steel wire that has been hot-rolled at 1000° C. is rapidly cooled to a temperature that corresponds to its lower pearlite range. The steel wire is then isothermally transformed and brought to a hardness of 50 HRC by cold drawing without intermediate annealing. The rapid cooling of the wire and its subsequent isothermal transformation results in a microstructure of fine-lamellar pearlite. This enables the wire to be drawn, after being descaled and phosphatized, without any intervening annealing.

SUMMARY OF THE INVENTION

The object of the present invention is to describe an especially economical process for producing hot-worked elongated products, especially bars or tubes, from high-alloy steel or hypereutectoid steel, especially anti-friction bearing steel, in which a microstructure is produced that is extremely well suited, without prior soft annealing, such as to spheroidal cementite annealing, for further chipless processing and final heat treatment. A further object is to describe a process for producing a microstructure that is also suitable, without prior soft annealing, for further metal-cutting processing with a subsequent final heat treatment.

The coordinated process steps of the invention make it possible to produce the desired microstructure, whereby, in the case of the anti-friction bearing steel, a brinell hardness less than or equal to 280 HB 30, preferably less than 250 HB30, is achieved. This microstructure also makes it possible to feed hot-worked tubes directly to a processing unit, without soft annealing. The manufacturing process of the present invention is especially economical, because it omits soft annealing and the transport and work steps associated therewith. The hot-worked elongated products according to the invention can be processed by cold drawing, cold pilger rolling, cold rolling or cross rolling.

BRIEF DESCRIPTION OF THE DRAWINGS

In the drawings,

FIG. 1 is a structure after a prior art procedure including spheroidal cementite annealing.

FIG. 2 is a structure after the procedure according to the invention without an annealing step.

DETAILED DESCRIPTION OF THE PREFERRED EMBODIMENTS

The individual steps that contribute to the success of the process according to the invention are explained in what follows: The first process step, which occurs after the initial deformation and before reheating for subsequent continuous rolling, is equalizing a temperature using a controlled heating or cooling to achieve temperature equalization over the length and circumference of the rolled material, which has various temperatures. The equalization temperature is lower than the preset temperature of the reheating furnace. The purpose of this measure is, first of all, to precisely adjust the temperature of the rolled material, and taking into account the opportunities to regulate temperature in the reheating furnace. Secondly, the measure is intended to achieve the most precise and reproducible conditions possible for the temperature-dependent measurement of wall thickness that takes place before the tube enters the reducing mill. The measure chosen, (either heating or cooling), depends on the thickness of the material to be rolled. For example, in the case of a pipe push bench arrangement, the temperatures of thick-walled tubes after the initial deformations of piercing, elongation and striking are above 700° C. because the large mass retains heat. In such cases, temperature equalization is achieved by controlled cooling to a preestablished equalization temperature in the range between 650° and 700° C. In thin-walled tubes, which cool very quickly, temperatures are frequently below 650° C. In this case, temperature equalization is achieved by controlled heating to a preestablished equalization temperature in the aforementioned range of 650° to 700° C.

Actual reheating is carried out either to a temperature below $Ac_1$ (Critical temperature between pearlite phase field and austenite phase field on heating) but above 650° C., or to a temperature above $Ac_1$ but below $A_{cma}$ (critical temperature between cementine-austenite phase field and austenite phase field where a=the start of the carbide dissolution region). It is necessary to take into account the well-known fact that the $Ac_1$ or $A_{cma}$ temperature depends primarily on the carbon content of the material used and on its deformation history. The former of the temperature ranges mentioned above corresponds to the second phase region $\alpha+Fe_3C$ in the continuous TTT diagram, while the latter temperature range corresponds to second phase region $\gamma+Fe_3C$.

A further measure in the proposed combination of coordinated process steps relates to the final continuous rolling process, preferably in a stretch reducing mill. Unlike other rolling methods, this rapid continuous rolling offers few opportunities for intervention. It is nonetheless important for the proposed process that, first of all, a minimum partial deformation, expressed as the stretching $\lambda\lambda \geqq 1.03$. be maintained in the reducing mill per each stand and that, secondly, a minimum stretching degree be maintained for the total deformation $\lambda\lambda \geqq 1.5$. In special cases, the total stretching can even be somewhat deeper, for instance, $\lambda\lambda \geqq 1.4$. In addition, any temperature increase that occurs during rolling due to loss work, or any temperature decrease that results from excessive cooling, should be minimized. In all cases, rolling must take place in the given two-phase region, and the rolled material leaving the final stand must have a temperature corresponding to that of the region in question. This means that during the preferred rolling in the $\gamma\gamma+Fe_3C$ region, the temperature of the rolled material must not exceed $A_{cma}$. Compliance with this narrow temperature range is achieved by cool means control; additional heat, in special cases, from an external heating device; and variations in the geometry of the rolls, roll speed and pass reduction. In roller geometry, the pressed length is especially significant.

The process according to the invention is generally applicable for all known tube-making processes that end in a reducing mill with or without draught or in a sizing mill. For example, the process can be used on a continuous tube train, a plug train or an Assel mill. In particular, it is suitable for the push bench method of producing seamless tubes of anti-friction bearing steel. The feedstock for the process according to the invention can be ingot cast material (forged or rolled) or strand cast material (square or round), whereby the strand cast material is deformed and annealed in a known manner prior to rolling. Tests have shown that the process can be used especially advantageously when the chemical analysis of the known anti-friction bearing steel is modified. This relates, firstly, to the sulphur and phosphorous content and, secondly, to the ratio of chromium to carbon. To avoid possible melt-out at the grain boundaries when deformation rates rise, the maximum sulphur and phosphorous contents should each equal 0.005 w/o, taking into account the ratio of manganese to sulphur due to the suppression of FeS. The melt-out danger results from the high deformation temperatures required during the initial deformation steps, when deformation rates are such as to lead to corresponding temperature increases. For this reason, the deformation rate in the initial deformation steps is selected in such that the temperature in the interior of the rolled material, (the least advantageous point), does not exceed 1170° C. In addition, low S and P contents have an advantageous effect on any subsequent chipless deformation.

With respect to secondary metallurgy, the declining S and P contents are also advantageous in establishing a low oxygen content in the melt, which leads to an improvement of the oxidic purity.

The chromium-to-carbon ratio should be in the range of 1.35 to 1.52, preferably 1.45. The carbon content then equals 0.94 w/o, for example, while the chromium content equals roughly 1.36 w/o. Undesirable carbide banding can be positively influenced via this ratio.

When anti-friction bearing steel is used, the cost advantage that results from omitting soft annealing, which otherwise would be necessary, can be further increased by using a strand cast bar with no predeformation, (in the cast state and without prior heat treatment (diffusion)), as the feedstock.

Another improving measure relates to the cooling step that follows the final deformation. After leaving the rolling mill, the rolled material is cooled in resting air or by an air shower to a temperature corresponding to a microstructure located above the martensite point and below the bainite nose in the TTT diagram. The deformed material is held in this area isothermally for several hours. This method has proved advantageous in the reduction of internal stresses. This step can be carried out by placing the rolled material on a cooling bed covered at a suitable point in a heat-insulating manner, or by feeding the rolled material to a temperature equalization furnace or tempering furnace.

To dispense with the hardening of individual finished products after machining, it is further proposed that the rolled material, after cooling, be heated to a temperature in the range 600° to 700° C., cooled and then tempered at a temperature in the range 180° to 210° C. After the heating and tempering, the rolled material has a hardness corresponding to the required final hardness of the finished product.

The proposed new process technology for manufacturing hot-worked elongated products, especially bars or tubes, from anti-friction bearing steel has the following advantages:

a) The process eliminates investment expenditures for a special annealing furnace and operating costs for long-term spheroidal cementite annealing.

b) The process eliminates transport and work steps (annealing, straightening) and thus reduces opportunities for defects, resulting, at shorter operational run times, and in more economical hot-worked products or cheaper feedstocks for further deformation steps.

c) The process improves material exploitation by shortening work sequences and attaining low decarburization depths due to omission of oxidizing annealing. This leads to small allowances and thus lower machining volumes and allows customers to retain their gripping clamp dimensions.

d) The process eliminates the requirement for straightening. Due to the reduced deformation temperature, the rolled material leaving the rolling mill has greater rigidity and becomes sufficiently straight on the cooling bed. Straightening can therefore be omitted, as a rule.

e) The process produces is markedly fine grained microstructure. During heat treatment, this leads to higher and more homogeneous hardness and better toughness. This has a positive effect on the later useful life of the finished product, e.g., roller bearings.

f) The process achieves a microstructure that can be subjected, without additional heat treatment, to a cold deformation process, e.g., cold drawing, cold pilger rolling, cold rolling or cross rolling. After stress-relief annealing, cold drawn tubes have the same properties as cold pilger rolled tubes.

g) The process saves money during melt production due to the reduced S and P contents and the Cr and C contents set at the lower limits. Minimizing carbide banding and improving oxidic purity increases the useful properties of the finished product.

The process according to the invention will be described in greater detail in reference to an example. A hot-worked tube with dimensions of 40.9 mm in external diameter×4.8 mm in wall thickness is to be produced from 100Cr6 steel on a tube push bench machine. From a strand cast bar 220 mm in diameter and 11,000 mm in length, feedstock ingots approximately 850 mm in length are cut. The feedstock ingots of 100 Cr6 steel are in the cast state, i.e., they have not been heat-treated or predeformed. The cut ingots are placed into a rotary hearth furnace and heated to approximately 1140° C. After a total heating time of 150 minutes, the ingots are removed individually from the furnace and, after pressurized water descaling, fed to a piercing press. In the piercing press, the initial deformation into a pierced piece takes place. In this example, the pierced piece has the following dimensions:

| | |
|---|---|
| Outer diameter | 223 mm |
| Inner diameter | 121 mm |
| Wall thickness | 51 mm |

This deformation corresponds to a cross-sectional reduction of 29.4% and stretching of $\lambda$=1.42. In this example, the deformation rate equals 0.45 $s^{-1}$ and influences the optimal temperature window. After the piercing press, another deformation occurs, namely elongation in a shoulder mill. This deformation produces a shell with an outer diameter of 192 mm, an inner diameter of 112 mm and a wall thickness of 40 mm. The cross-sectional reduction is 30.7% and the stretching $\lambda$=$\lambda$1.44. During this deformation, high temperatures arise on the inner surface during rolling. Therefore, special care must be taken to ensure that the temperature on the shell inner surface does not exceed 1170° C. Otherwise, inner surface defects must be expected due to grain boundary melt-out. Changes in roll speed and transport angle can be used as control variables. The third deformation step is striking on the push bench. A push bench billet with an outer diameter of 122.8 mm, an inner diameter of 112 mm and a wall thickness of 5.4 mm is produced as the selected final size. After being pushed through a number of stands, the billet from the bar is detached in a detaching mill in the form of an internal die. The temperature of the billet continues to drop until the extracting of the push bar and reaches, in the described case, a level in the range of 650° to 700° C. After extraction of the push bar, the billet plug is created. According to the invention, the billet, before entering the reheating device, is subjected to controlled cooling to attain a uniform temperature distribution in the range between 650° C. and 700° C. In this case, a temperature of approximately 670° C. is striven for. The billet is held for a certain time in a heat-insulating buffer, so that heat can flow from the areas of the billet with a higher temperature to the areas with a lower temperature. The heat insulation ensures that the total level of the billet temperature does not fall below the preset target value. In this example, the temperature of the reheating furnace is set such that a temperature of roughly 740° C. is achieved in the deformation material. At this temperature, the billet runs into a stretch reducing mill. This mill comprises a large number of three-roll stands, which are arranged offset by 120° in a roll line. For the selected example with the final dimensions of 40.9×4.8 mm, 29 stands are used. The partial deformation in the base stands equals a cross-sectional reduction of between 7.1 and 8.1%. The total deformation equals 72.7% in keeping with a stretching $\lambda\lambda$ of 3.66. The deformation conditions are selected (i.e., the pass design and roll speed are chosen and the cooling is adjusted) in such a way as to permit a slight temperature increase to 760° C. This ensures that deformation in the stretch reducing mill takes place completely in the two phase region $\gamma\gamma$+$Fe_3C$. After cooling, tubes of 100Cr6 steel rolled in this manner have a microstructure that comes near to the spheroidal cementite microstructure. The finely dispersed microstructure consists of spheroidized cementite with slight pearlite residues. The brinell hardness of the tube produced in this fashion is below 250 HB30. The distribution of hardness values is slight. The microstructure is finer than that achieved by standard spheroidal cementite annealing, as can be seen by comparing FIGS. 1 and 2.

The tube produced according to the invention can be further processed without additional heat treatment in a chipless or metal-cutting fashion. This processing can consist, for example, of cold drawing. By using one of the, deliberate temperature control before entry into the reheating furnace, reduced reheating furnace temperature, compared to the usual method, rolling in the two-phase region, and, omission of spheroidal cementite annealing lasting over 16 hours, a much thinner decarburized layer is obtained, compared to the known prior art. The tube dimensions needed for machining can therefore be reduced. Despite stress-relief annealing after straightening, cold-drawn tubes with microstructure attainable according to the invention have the same properties as cold-pilgered tubes.

To make clear the difference between the new process technology and the known prior art, products of the same final size (40.9 mm outer diameter×4.8 mm wall thickness) were also rolled of 100Cr6 steel according to the usual method. The hardness found in these tubes equaled 328 HB30 at a reheating furnace setting of 1000° C. This hardness is so high that spheroidal cementite annealing is required prior to further processing.

In producing thick-walled hot tubes, (for example, 60.3×8.0 mm), it is advantageous to control cooling based on the TTT diagram such that an isothermal holding period is introduced above the martensite point, but below the bainite nose. The temperature range is preferably between 240° and 300° C. After a holding period of more than 3.5 hours in this temperature range, cooling to ambient temperature can take place.

We claim:

1. A process for producing a hot-worked elongated element from one of a high alloy and a hypereutectoidal steel, including the steps of:

initially deforming a feed stock at a deformation temperature by feeding said feedstock through a reducing mill at a predetermined deformation temperature;

producing a uniform temperature distribution throughout a length and thickness of the deformed feedstock after said step of initially deforming by controlled heating or cooling to a preestablished temperature;

reheating the deformed feedstock to a temperature within one of a first temperature range of 650 degrees C. to $Ac_1$ and a second temperature range of $Ac_1$ to $A_{cma}$;

deforming the reheated feedstock to a final form by continuously rolling the reheated feedstock in a multi-stand reducing mill for a total deformation of $\lambda \geqq 1.5$ and an individual deformation of $\lambda \geqq 1.03$ through each stand of the multi-stand reducing mill and maintaining a temperature of said reheated feedstock within a narrow range during said continuous rolling; and cooling the finally formed feed stock to ambient temperature.

2. The process of claim 1, wherein said step of producing a uniform temperature includes one of controlled heating and controlled cooling to a predetermined temperature within the range 650° C. to 700° C.

3. The process of claim 1, wherein the temperature $Ac_1$ is 710° C. and the temperature $A_{cma}$ is 880° C.

4. The process of claim 1, wherein said step of maintaining a temperature of said reheated feedstock to within a narrow range during said continuous rolling comprises at least one of cooling with a cooling device, adding heat using an external heating device, varying roll geometry, varying roll speed, and varying the amount of reduction per each stand in the reducing mill.

5. The process of claim 1, wherein said feedstock comprises an anti-friction bearing hypereutectoid steel having a maximum respective sulphur and phosphorus content of 0.005 w/o and a chromium-carbon ratio in the range of 1.35 to 1.52.

6. The process of claim 5, wherein the chromium-carbon ratio is 1.45.

7. The process of claim 1, wherein said feedstock comprises, before said step of initial deforming, a strand cast bar without any predeformation.

8. The process of claim 1, wherein said step of initially deforming includes limiting a deformation rate such that the highest temperature at the interior of the feedstock does not exceed 1170° C.

9. The process of claim 1, further including the step of cooling the finally rolled feedstock to a holding temperature above a martensite temperature and below a bainite nose temperature according to a TTT diagram for the feedstock material and holding said finally formed feedstock at said holding temperature for a holding period before said step of cooling said finally formed feedstock to ambient temperature.

10. The process of claim 1, wherein said step of cooling the finally formed feedstock further comprises the steps of:

cooling the finally formed feedstock;

heating the cooled finally formed feedstock to a temperature with the range 650° C. to 700° C.;

tempering the finally formed feedstock at a temperature in a range of 180° C. to 210° C.; and cooling said tempered final feedstock in ambient air.

* * * * *